US009844717B2

(12) United States Patent
Lee et al.

(10) Patent No.: US 9,844,717 B2
(45) **Date of Patent: *Dec. 19, 2017**

(54) MOBILE BASEBALL PITCHING MOUND

(71) Applicant: Porta-Pro Mounds Inc., Sauget, IL (US)

(72) Inventors: William S. Lee, O'Fallon, IL (US); Richard A. Sauget, Sauget, IL (US)

(73) Assignee: Porta-Pro Mounds Inc., Sauget, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/170,453

(22) Filed: Jun. 1, 2016

(65) Prior Publication Data

US 2016/0271479 A1 Sep. 22, 2016

Related U.S. Application Data

(63) Continuation of application No. 13/743,167, filed on Jan. 16, 2013, now Pat. No. 9,474,954.

(60) Provisional application No. 61/586,992, filed on Jan. 16, 2012.

(51) Int. Cl.

| | |
|---|---|
| ***A63B 71/00*** | (2006.01) |
| ***A63B 71/02*** | (2006.01) |
| *A63B 69/00* | (2006.01) |

(52) U.S. Cl.

CPC ..... *A63B 71/02* (2013.01); *A63B 69/0013* (2013.01); *A63B 69/0002* (2013.01); *A63B 2069/0006* (2013.01); *A63B 2209/00* (2013.01); *A63B 2209/02* (2013.01); *A63B 2210/50* (2013.01)

(58) Field of Classification Search

CPC ..... A63B 69/0002; A63B 69/0013; A63B 2069/0006; A63B 71/02; A63B 2209/00; A63B 2209/02; A63B 2210/50

USPC ..... 473/497, 499, 452; D21/780; 273/DIG. 7

See application file for complete search history.

(56) References Cited

U.S. PATENT DOCUMENTS

| | | | | |
|---|---|---|---|---|
| 4,063,729 | A | 12/1977 | Hollaway | |
| 4,925,186 | A | 5/1990 | Stevenson et al. | |
| 5,058,889 | A | 10/1991 | Burton | |
| 5,213,323 | A | 5/1993 | Novinsky | |
| 5,467,977 | A * | 11/1995 | Beck | A63B 69/0013 473/497 |
| 5,624,112 | A | 4/1997 | Hummel et al. | |
| 5,707,305 | A | 1/1998 | Goeders et al. | |
| D520,094 | S | 5/2006 | Hess | |
| 8,157,678 | B2 | 4/2012 | Goeders | |
| 9,474,954 | B2 * | 10/2016 | Lee | A63B 69/0013 473/497 |
| 2003/0220161 | A1 | 11/2003 | Putnam | |
| 2004/0242352 | A1 | 12/2004 | Panus | |
| 2007/0111828 | A1 | 5/2007 | Goeders | |

(Continued)

OTHER PUBLICATIONS

Website, SportsAdvantage.com, "Baseball—Portable Pitching Mounds," http://www.sportsadvantage.com/category.php?category=207&sport=1&page=4, printed on Jul. 19, 2011, one page.

*Primary Examiner* — Mitra Aryanpour
(74) *Attorney, Agent, or Firm* — Lewisr Rice LLC

(57) ABSTRACT

A portable pitching mound that offers the strength and durability of a traditional dirt mound that is compatible with turf fields and will not create an edge lip on a baseball field.

2 Claims, 16 Drawing Sheets

(56) References Cited

U.S. PATENT DOCUMENTS

| | | | |
|---|---|---|---|
| 2013/0196797 | A1 | 8/2013 | Lee et al. |
| 2013/0345000 | A1 | 12/2013 | Gangwer et al. |

* cited by examiner

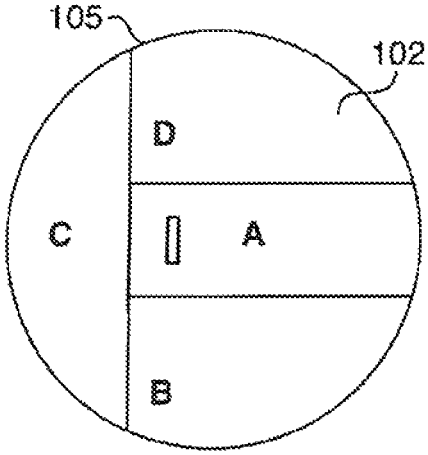
FIG. 8A
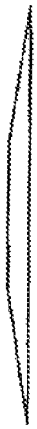
FIG. 8C
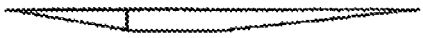
FIG. 8B
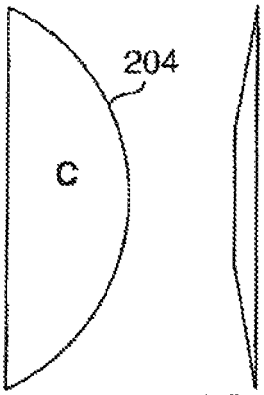
FIG. 8D
FIG. 8E
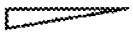
FIG. 8F
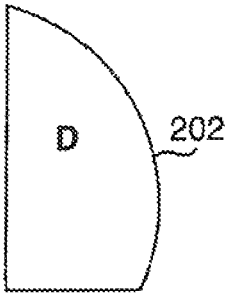
FIG. 8G
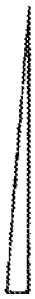
FIG. 8H
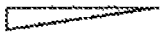
FIG. 8I
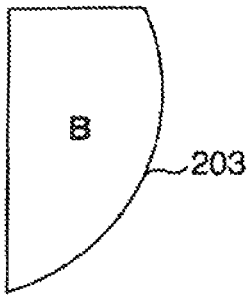
FIG. 8J
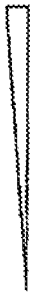
FIG. 8K
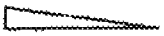
FIG. 8L
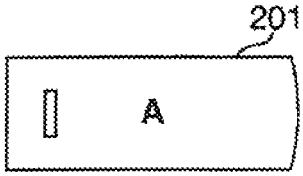
FIG. 8M
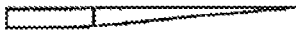
FIG. 8N
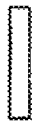
FIG. 8O

MOBILE BASEBALL PITCHING MOUND

CROSS REFERENCE TO RELATED APPLICATION(S)

This application is a Continuation of U.S. patent application Ser. No. 13/743,167 filed Jan. 16, 2013 and currently pending, which in turn, claims the benefit of U.S. Provisional Patent Application Ser. No. 61/586,992, filed Jan. 16, 2012. The entire disclosure of all the above documents is incorporated herein by reference.

BACKGROUND

1. Field of the Invention

This disclosure is related to the field of equipment used in the sport of baseball in particular to portable pitching mounds.

2. Description of Related Art

The game of baseball takes place on a baseball diamond or what is colloquially referred to as a "ball field." During a baseball game, a pitcher throws or "pitches" a baseball over a plate known as home plate which a batter stands besides, attempting to strike the pitched baseball with a bat. The rules governing the sport of baseball require that the pitcher throw the baseball from an upraised portion of the playing field called a pitcher's mound. Generally, the low artificial hill on a baseball field which functions as the pitcher's mound is roughly in the middle of the diamond, equidistant between first and third base, closer to home plate than second base.

Baseball's governing rides require that, for a pitch to be valid, the pitcher must have one foot in contact with a slab installed on the pitcher's mound, known as the pitcher's plate or "rubber." The size and relative deposition of elements of a baseball field, such as home plate, the rubber and the pitcher's mound are specified in the rules. Generally, these rules regarding the elements of the baseball field vary depending on the league or level of the game. For example, the mandated size and relative deposition of these elements might differ at the Major League Baseball, college, high school and little league levels. For example, in Major League Baseball, a regulation pitching mound is generally 18 feet in diameter and at most about 10.5 inches high, with the center about 59 feet from the rear of home plate, on the line between home plate and second base.

The exact shape and composition of a pitching mound can have a considerable effect on a pitcher's actions and his ability to pitch a baseball. As a pitcher pitches on a mound, his leading foot will land at a position significantly lower than his trailing foot. Further, due to the height of the mound, the pitcher is pitching down to the batter. In addition, the interaction between the pitching mound and a pitcher's body weight, also known as the "give" of the mound, can have an effect on a pitcher's delivery. For these reasons, pitchers generally develop certain habits based on the shape, composition and feel of the mound.

In the off-season, it is generally common for baseball players to practice indoors in a gymnasium or other indoor facility. Often when practicing in these environments, pitching practice will take place on a level floor. This can be awkward for the pitcher and, due to the inherent differences in shape, composition and feel, can detrimentally affect his or her pitching style. Accordingly, there is a need for a portable, easy-to-utilize pitcher's mound that can be used in an indoor training environment to simulate a traditional pitcher's mound.

Further, the advent and improvement of artificial turf on baseball fields has also given rise to the need for portable or permanent artificial pitching mounds. Currently utilized artificial pitching mounds generally consist of actual dirt, which can decompose the artificial turf around the existing pitching mound, thus damaging the turf field and creating costly repairs. In addition, traditional dirt pitching mounds are notoriously difficult to maintain for groundskeepers, usually requiring a watering-down prior to games to keep dust and dirt from spreading. This increased maintenance can drive up the costs of caring for a baseball field and create a certain variability regarding the integrity of the baseball mound from game-to-game or even from inning-to-inning.

While portable pitcher's mounds have been developed and are known in the art these previously utilized prior devices have a number of shortcomings. For example, generally these known portable pitching mounds are primarily designed for indoor use; i.e., they are not designed to adapt to and integrate into a traditional grass or artificial turf baseball field. Many of these already known and used designs in the art, when utilized in a traditional or artificial turf baseball field, fail to smoothly integrate with the field, thus creating a lip or edge on the field around the circumference of the portable mound. This lip or edge can interfere with and effect live play. This lip or edge can also create safety issues for the pitchers and other players and officials on the field. For example, the bounce of a baseball striking this edge could be erratic and therefore not representative of the result that would be obtained from the ball striking a clay or earth mound. Further, these bad bounces caused by the lip or edge could catch a player or official off-guard, leading to injury. These lips or edges are also a safety hazard in that players and officials can trip and fall over these irregularities in the field.

A further disadvantage of the portable pitcher's mounds of the prior art is that their surface and composition is dissimilar from that of traditional mounds which are formed from earth or clay. Many of these known portable pitching mound devices are comprised of simply a board or layer of material with nothing underneath. This type of constriction creates a portable pitcher's mound that is either inadequately rigid or overly rigid, providing either too much flex or not enough flex, thereby interfering with the accuracy of a pitcher's delivery and throw. Further, these portable mounds can have a surface that is harder than that of traditional dirt or clay mounds. These mounds can create a hazard to the safety of a pitcher in certain circumstances where, when struck by a baseball in play, they do not absorb as much of the impact as a traditional mound and run the risk of deflecting the ball up and potentially injuring the pitcher. In addition, a pitcher can turn an ankle if he hits the lip incorrectly during play. Moreover, these portable mounds are often manufactured from plywood, aluminum, steel or concrete materials which, due to their rigidity, can be dangerous and may cause injuries to baseball players and also create damage to artificial turf fields.

Finally, the mounds of the prior art with an interchangeable hub-and-spoke design, by their inherent structure, create seams between the push off mound and the landing area. These seams near the rubber and the pitcher's push off and landing areas alter the strength and integrity of this portion of the mound, areas which must be of ultimate strength to properly support a pitcher's weight and the sifting thereof. Further, there can be separation at these seams which can interfere with a pitcher's wind-up and release and, in certain circumstances, can cause slippage by the pitcher. In addition, the "spoke" pie-shaped pieces of the mound in these prior art structures are interchangeable. Thus, by design, the rubber of these mounds must be in the center or middle of the circle. This structure varies from the traditional mound utilized in Major League Baseball and at the college and high school levels where, while the mound is a circle, the rubber is actually behind the center point of the mound.

SUMMARY

Because of these and other problems in the art, described herein, among other things, is a portable pitching mound that offers the strength and durability of a traditional dirt mound that is compatible with turf fields and will not create an edge lip on a baseball field.

In one embodiment of the portable pitching mound, the portable pitching mound is comprised of: a mound body comprised of two or more component parts, the mound body having a lower surface, a generally convex upper surface and a peripheral flange; and an interlinking flange attachment methodology comprised of one or more interlinking flanges on one or more of the two or more components parts of the mound body; wherein the interlinking flange attachment methodology attaches the two or more component parts of the mound body to each other to create an integrated portable pitching mound.

In one embodiment of the portable pitching mound, the one or more interlinking flanges are comprised of one or more channels.

In another embodiment of the portable pitching mound, the interlinking flange attachment methodology is further comprised of one or more mating mechanisms on one or more of the two or more component parts of the mound body, wherein the one or more mating mechanisms correspond with the one or more channels of the one or more interlinking flanges.

In yet another embodiment of the portable pitching mound, the portable pitching mound is further comprised of a rubber, the rubber being located on the generally convex upper surface of the mound.

In certain embodiments of the portable pitching mound, the mound body has a generally arcuate shape.

In other embodiments of the portable pitching mound, the upper surface and the lower surface are comprised of fiberglass.

In another embodiment of the portable pitching mound, a core material and a reinforcement system are located between the upper surface and the lower surface. In one embodiment of the portable pitching mound, the core material and reinforcement system are comprised of solid foam.

Further, in another embodiment of the portable pitching mound, the mound body is comprised of three pieces: a center piece, a left piece and a right piece. In yet another embodiment of the portable pitching mound, the mound body is comprised of six pieces: a front center piece, a back center piece, a front left piece, a back left piece, a front right piece and a back right piece.

In another embodiment of the portable pitching mound, the generally convex upper surface of the mound body is covered with artificial turf.

Also disclosed herein is a method for installing a portable pitching mound, the method being comprised of the following steps: providing a portable pitching mound, the portable pitching mound being comprised of: a mound body comprised of two or more component parts, the mound body having a lower surface, a generally convex upper surface and a peripheral flange; and an interlinking flange attachment methodology comprised of one or more interlinking flanges on one or more of the two or more components parts of the mound body; attaching the two or more component parts of the mound body to each other via the interlinking flange attachment methodology to create an integrated portable pitching mound.

In one embodiment, the method further comprises the step of attaching artificial turf to the generally convex upper surface of the portable pitching mound.

BRIEF DESCRIPTION OF THE DRAWINGS

FIGS. 8A, 8B, 8C, 8D, 8E, 8F, 8G, 8H, 8I, 8J, 8K, 8L, 8M, 8N, and 8O provide side and aerial views of each of the four separate modular parts in both their separate and combined mound orientations in the embodiment of the portable pitching mound comprised of four parts.

FIGS. 9-11 provide an aerial view of an embodiment of the pitching mound with five modular pieces in its individual parts and final composite formation.

DESCRIPTION OF THE PREFERRED EMBODIMENTS

Figure 1:
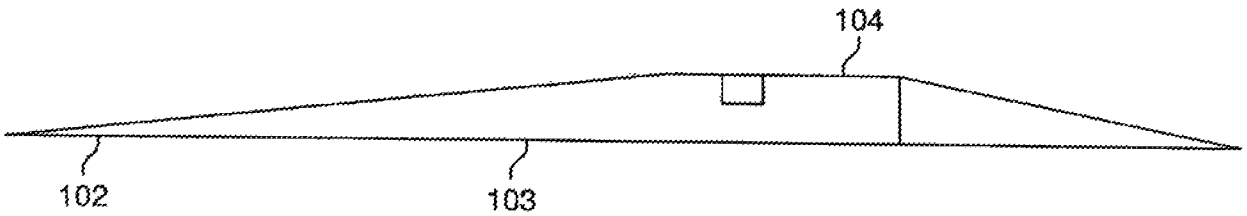
FIG. 1 provides a side view of an embodiment of the portable pitching mound.

This disclosure is intended to teach by way of example and not by way of limitation In its simplest form, the portable pitching mound (101) disclosed herein is generally comprised of a mound body (102) with a lower surface (103) and a generally convex upper surface (104), as provided in the side view of FIG. 1.

As demonstrated in FIG. 1, the general apex of the convex upper surface (104) is generally the place on the convex upper surface (104) where the rubber (200) or, in certain embodiments, the molded insert in the convex upper surface (104) for the rubber (200) will be located. It should be noted that, depending on the embodiment of the portable pitching mound (101), the general apex of the convex upper surface (104) is not necessary commiserate with the center point of the mound (101). Further, while generally of a convex orientation, in certain embodiments, it is contemplated that the length of one portion of the perimeter of the convex upper surface (104) to the apex might be longer than another portion of the perimeter of the convex upper surface (104) to the apex. For example, as seen in FIG. 1, the distance from the front of the mound (101) (the portion of the mound (101) closest to home plate) to the rubber (200) is longer than the distance from the back of the mound (101) (the portion of the mound (101) closest to second base) to the rubber (200). Further, the apex of the convex upper surface (104), in certain embodiments, might be a generally flattened portion of the top of the convex upper surface, as seen in FIG. 1. Stated differently, the apex of the convex upper surface (104) where the rubber (200) is located is generally flat in orientation.

Figure 2:
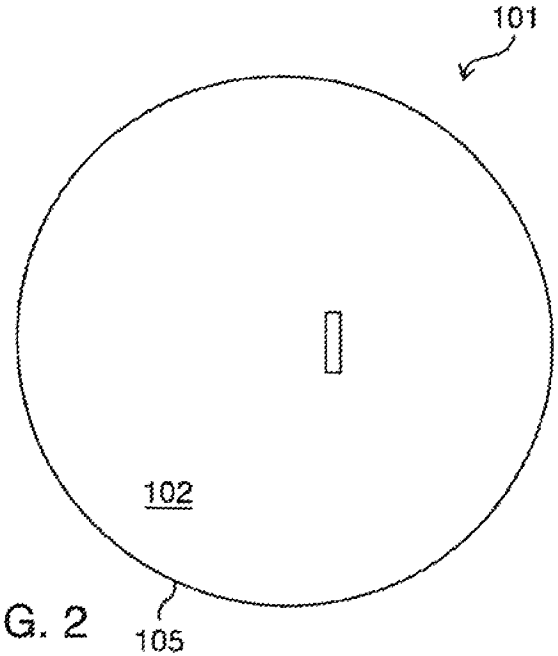
FIG. 2 provides an aerial view of an embodiment of the portable pitching mound.

Further, as demonstrated in FIG. 2, it is generally contemplated, in certain embodiments, that the perimeter of the mound body (102) of the portable pitching mound (101), the peripheral flange (105), has a generally arcuate or circular shape. However, it should be noted that other shapes besides circular shapes are contemplated in different embodiments for the peripheral flange (105) of the portable pitching mound (101). For example, in certain contemplated embodiments of the portable pitching mound (101) disclosed herein for use in, amongst other things, bullpens and other training environments, the peripheral flange (105) of the mound body (102) may be square, rectangular or another known polygonal shape. Generally, any shape for the peripheral flange (105) of the mound body (102) is contemplated that complies with or adheres to industry standards or needs for the use and shape of pitching mounds.

In the embodiments of the portable pitching mound (101) wherein the peripheral flange (105) is circular or arcuate in shape, the diameter of the peripheral flange (105) is not determinative and is expected to vary in accordance with the rules and regulations for the particular level of play in which the portable pitching mound (101) will be utilized. For example, in one embodiment the diameter of the peripheral flange (105) of the mound body (102) will be about 18 feet, the diameter currently mandated by Major League Baseball regulations. In another embodiment, the diameter of the peripheral flange (105) of the mound body (102) will be approximately 10 feet, the diameter currently mandated by Little League regulations. In other embodiments, it is contemplated that the diameter of the peripheral flange (105) will be engineered to meet the regulations of the applicable governing authority, e.g., Pony League, Junior High School, high school, college and Minor League Baseball regulations. Similarly, in embodiments of the portable pitching mound (101) in which the shape of the peripheral flange (105) of the mound body (102) is a generally rectangular, square or polygonal-based shape, the diameter of the peripheral flange (105) of the mound body (102) will comprise with the currently mandated regulations of the pertinent authority or the dimensions required by the end-user or space.

The mound body (102) of the portable pitching mound (101) is generally of a modular form, meaning that it subdivides into smaller parts or modules. Although certain embodiments of the portable pitching mound (101) which are comprised of only one modular component are contemplated in this disclosure, in certain preferred embodiments the portable pitching mound (101) will be comprised of two or more modular components that, when assembled, create the portable pitching mound (101). Embodiments of the portable pitching mound (101) with two or more component modular parts are generally preferred since reduction of the portable pitching mound (101) into two or more modular component parts generally increases the portability of the portable pitching mound (101).

Figure 3A:
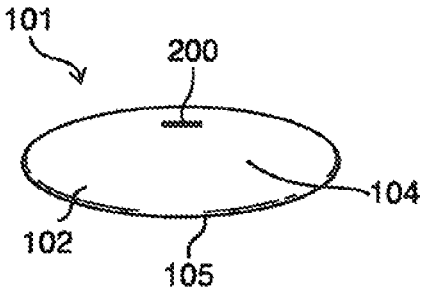
FIGS. 3A and 3B provide aerial views of an embodiment of the portable pitching mound comprised of three modular component parts in its separate and combined orientations.
Figure 3B:
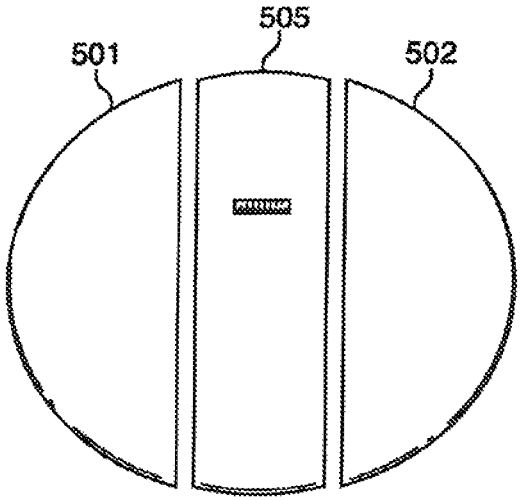
Figure 4A:
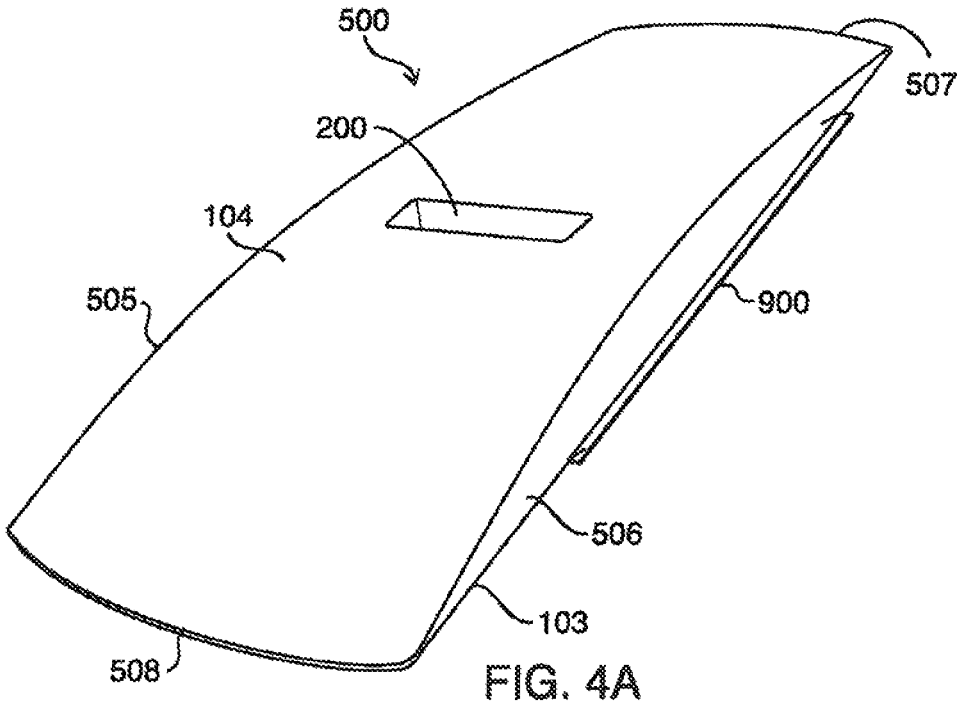
FIGS. 4A, 4B and 4C provide side views of each of the three separate interlocking parts of the portable pitching mound comprised of three parts.
Figure 4B:
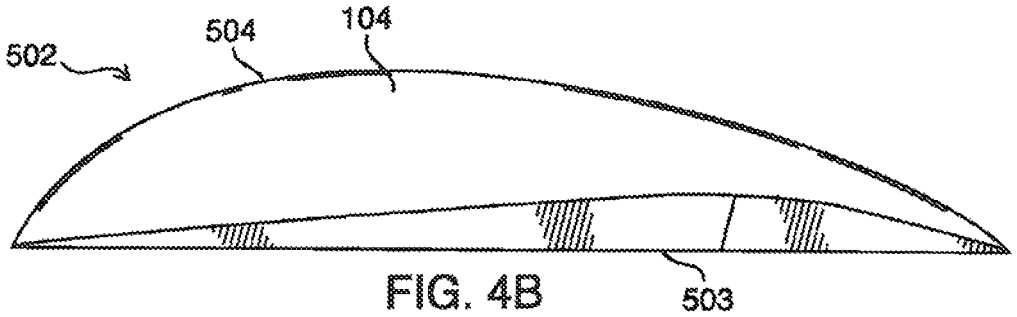
Figure 4C:
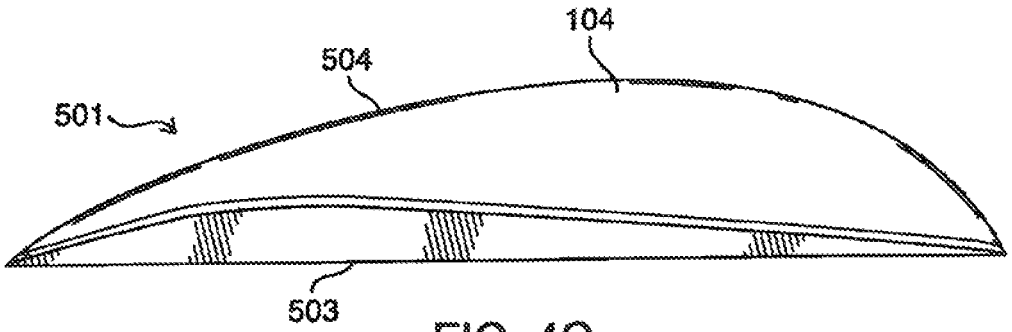

In one embodiment of the portable pitching mound (101), as depicted in FIGS. 3A, 3B, 4A, 4B, and 4C, the mound body (102) will be comprised of three separate interlocking modular parts, a center piece (500), a left side piece (501) and a right side piece (502). FIGS. 3A and 3B show an aerial view of the three-part mound (101) in its separate and combined orientation. FIGS. 4A, 4B and 4C show side views of each of the three separate interlocking modular parts. It should be understood that the dimensions and weight of each of these pieces is expected to vary in accordance with the particular regulations or venue specifications controlling the level of the game in which the mound (101) will be utilized. In one embodiment, the dimensions of the three-part portable pitching mound (101) will be engineered, to meet Little League mound specifications. Accordingly, in one embodiment, it is contemplated that the three piece interlocking part portable pitching mound (101) will be approximately seven inches in height and approximately ten feet in diameter.

Generally, as depicted in FIGS. 3A, 3B, 4A, 4B and 4C, the center piece (500) will include a rubber (200) or an insert for a rubber (200) and will generally be the sturdiest and heaviest of the pieces. Generally, once assembled, the entire range of motion for a pitcher in the pitching cycle will take place on the center piece (500). Notably, there is generally no lip or seam on the center piece (500)—it is a single unitary piece. In one embodiment, the insert for the rubber (200) will be about 4½" W×18" L×2½" H. In addition, in one embodiment, the rubber (200) will be located about 68¾" W from the front side (507), about 47" from, the back side (508) and about 11" from both the left side (505) and right side (505). Further, in certain embodiments of the portable pitching mound (101) wherein the portable pitching mound (101) has a generally circular shape, the center piece (500) in the three modular component part embodiment, as demonstrated in FIGS. 3A, 3B, 4A, 4B and 4C, will comprise the center strip of the circular portable pitching mound (101). Accordingly, as demonstrated in the side view provided in FIGS. 4A, 4B and 4C, this component part of the circular portable pitching mound (101) will have a generally convex orientation with the rubber (200) or insert for the rubber (200) located generally at the apex of the generally convex upper surface (104). As noted previously, and as demonstrated in FIGS. 4A, 4B and 4C, the apex of the generally convex upper surface (104) of the center piece (500) may be generally flat and is not necessarily located at the center of the generally circular portable pitching mound (101).

Further, as demonstrated in the aerial view of FIGS. 3A and 3B, the center piece (500) will be a portion of the center of the generally circular portable pitching mound (101). As such, the center piece (500) will have a left side (505) and a right side (506), The two side pieces (501) (502) of the three (3) modular component part pitching mound (101) will generally attach or interlock with the center piece (500) at the left side (505) and the right side (506). Further, the center piece (500) will also have a front side (507) and a back side (508), each of the front side (507) and the back side (508) comprising a portion of the circumference of generally circular portable pitching mound (101). In one embodiment, the center piece (500) will be about 120" L×40" W×7" H.

Figure 16:
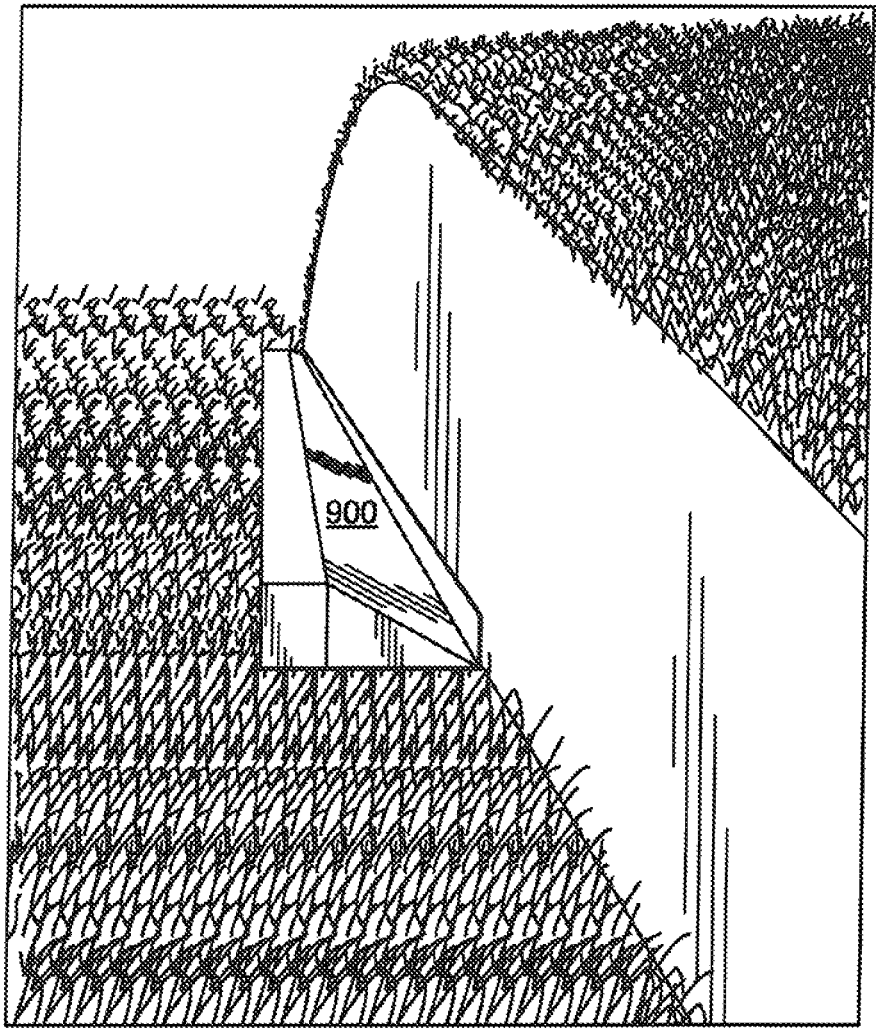
FIG. 16 provides a view of an embodiment of the flanges of the flange attachment methodology utilized in some embodiments of the portable pitching mound.
Figure 17:
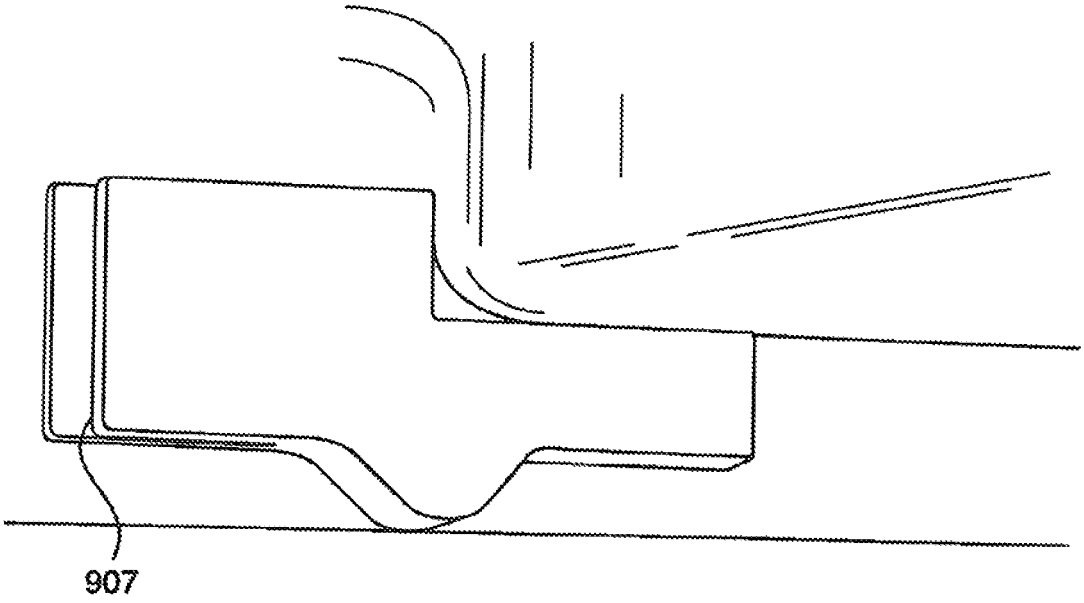
FIG. 17 provides a view of an embodiment of a locking mechanism utilized in one embodiment of the flange attachment methodology utilized in some embodiments of the portable pitching mound.
Figure 18:
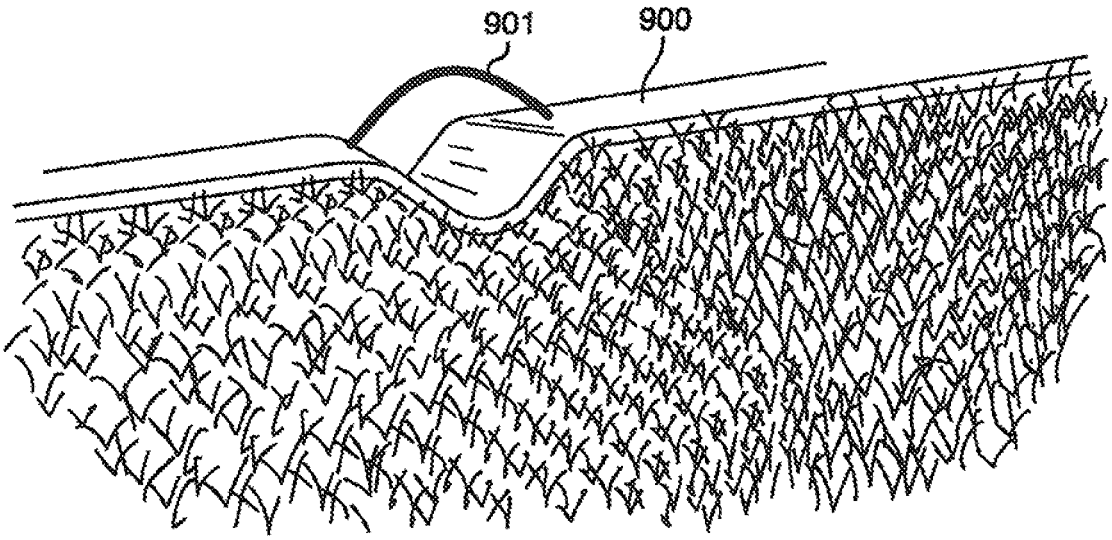
FIG. 18 provides a view of an embodiment of a channel utilized in one embodiment of the flange attachment methodology utilized in some embodiments of the portable pitching mound.

As will be discussed further herein, in one embodiment of the three modular part portable pitching mound (101), the three component parts will be attached to each other via a flange attachment methodology. In this embodiment, two flanges (900) will be located on the center piece (500) as depicted in FIGS. 4A, 4B and 4C, one flange (900) on the left side (505) and one flange (900) on the right side (506). In one embodiment, each of the flanges (900) will be about 68" L×2⅜" W. In one embodiment of the flanges (900), as seen in FIG. 16, the flange (900) will gradually angle upwards from the respective side of the center piece (500) to a certain distance above the lower surface (103) of the center piece (500) (e.g., in one embodiment about 1"), at which point it will level off. Notably, as will be discussed later in this application, this orientation for the flange (900) is not determinative. In certain embodiments of the flange (900), the flange (900) includes a channel (901) which is a generally curved groove that corresponds to a mating locking mechanism (907). FIG. 18 shows an embodiment of the channel (901) wherein the channel (901) is about 2" wide. In one embodiment, as depicted in FIG. 17, the locking mechanism (907) comprises a channel key attached to the straight side (503) of the left side piece (501) and right side piece (502). As depicted in FIG. 17, the locking mechanism (907) in this embodiment generally comprises a 2" wide sloping protrusion that mates with the 2" wide channel (901).

Further, as depicted in FIGS. 3A, 3B, 4A, 4B and 4C, the left side piece (501) and the right side piece (502) of the three modular component part portable pitching mound (101) are generally mirror images of each other and represent the left and right portions of the generally circular portable pitching mound (101). Both the left side piece (501) and the right side piece (502), as depicted in FIGS. 3A, 3B, 4A, 4B and 4C, generally have a semi-circle orientation. The straight side (503) of the semi-circle of the left side piece (501) and right side piece (502) is the portion of each of the left side piece (501) and right side piece (502) that connects to or interlocks with either the left side (505) or the right side (506) of the center piece (500). The circular side (504) of the semi-circle of the left side piece (501) and right side piece (502) is the portion of each of the left side piece (501) and the right side piece (502) that comprises a portion of the circumference of the generally circular portable pitching mound (101). Together with the back side (508) and front side (507) of the center piece (500), the circular side (503) of each of the left side piece (501) and the right side piece (502) creates the generally circular peripheral flange (105) of the embodiment of the portable pitching mound (101) comprised of three modular component parts.

Figure 5A:
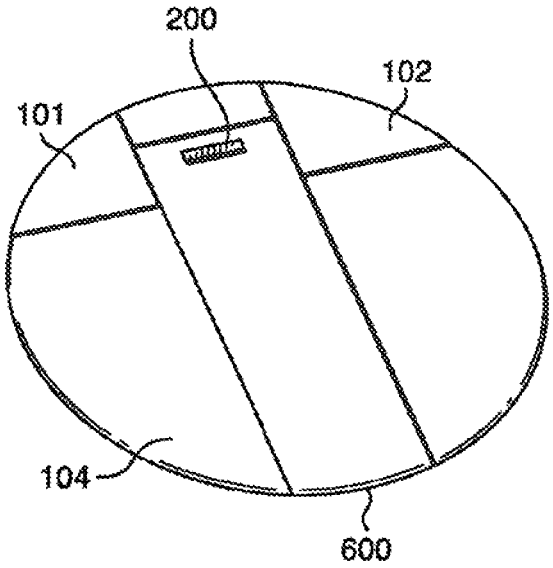
FIGS. 5A and 5B provide aerial views of an embodiment of the portable pitching mound comprised of six modular parts in its separate and combined orientations.
Figure 5B:
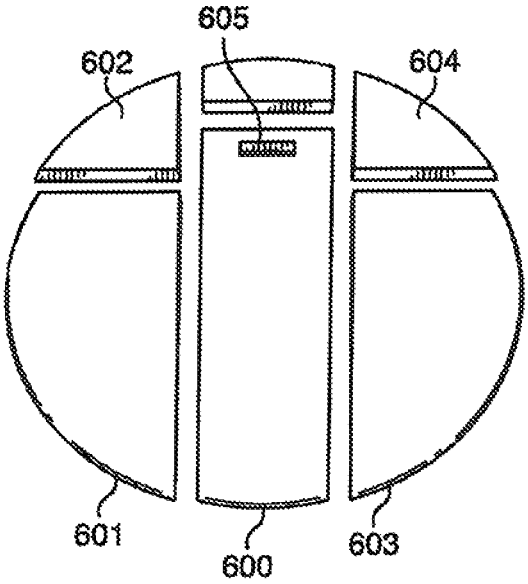
Figure 6A:
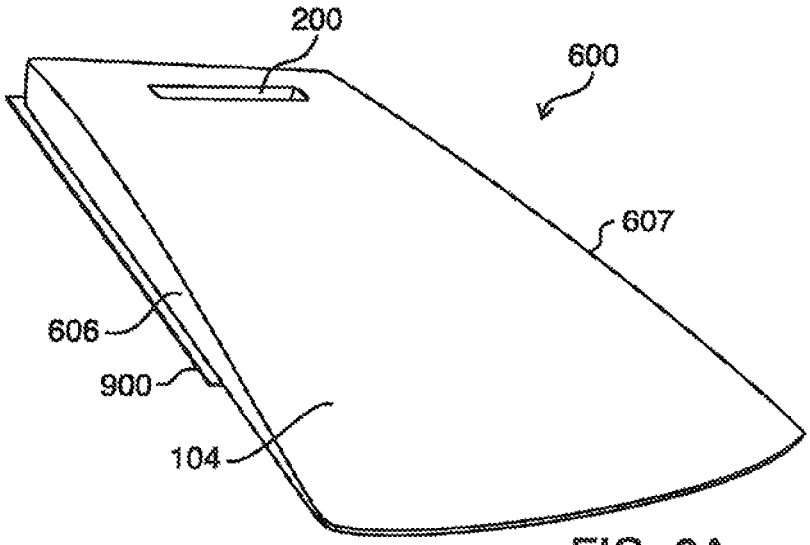
FIGS. 6A, 6B, 6C, 6D, 6E, and 6F provide side views of each of the six separate interlocking parts of the portable pitching mound comprised of six parts.
Figure 6B:
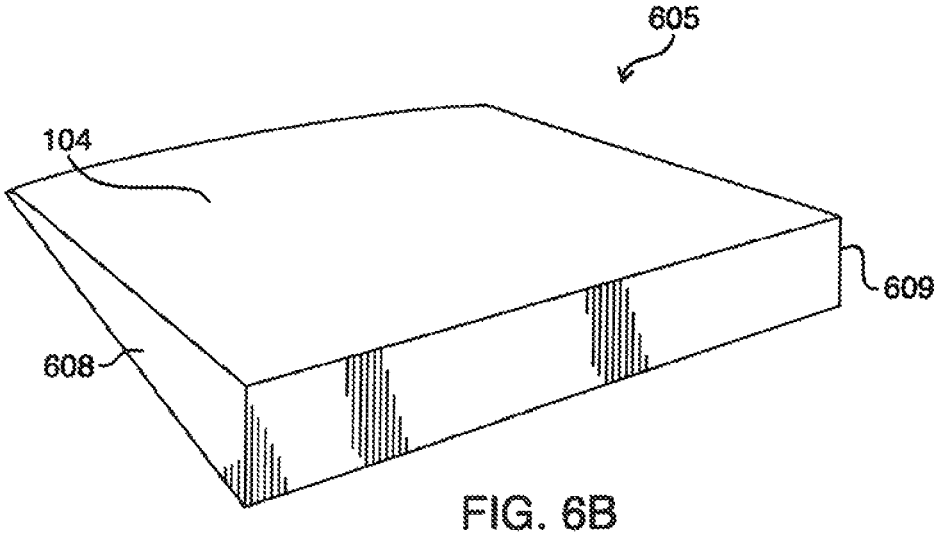
Figure 6C:
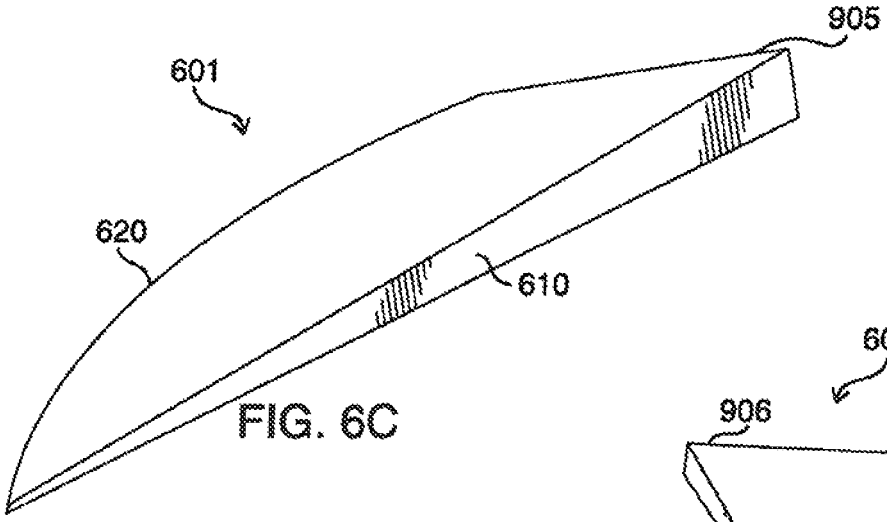
Figure 6E:
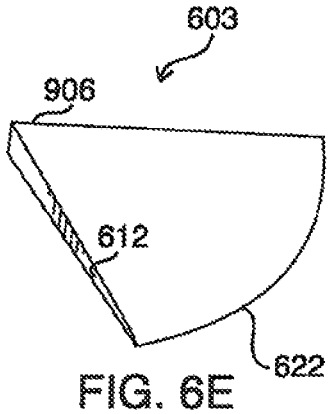
Figure 6D:
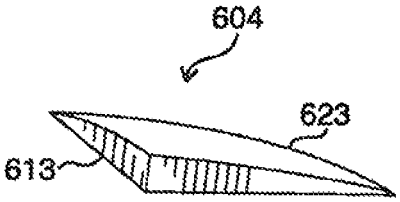
Figure 6F:
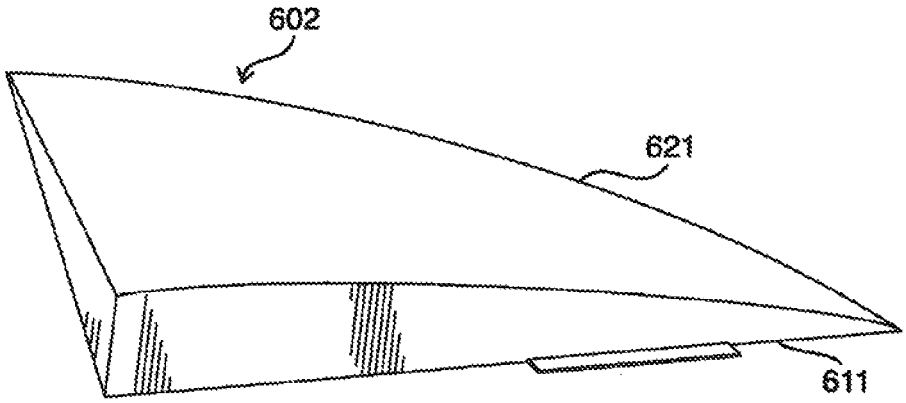

In another embodiment of the portable pitching mound (101), as depicted in FIGS. 5A, 5B, 6A, 6B, 6C, 6D, 6E and 6F, the mound body (102) will be comprised of six separate interlocking modular parts: a front center piece (600), a front left side piece (601), a back left side piece (602), a front right side piece (603), a back right side piece (604) and a back center piece (605). FIGS. 5A and 5B show an overhead view of the six-part mound (101) in its separate and combined orientation. FIGS. 6A, 6B, 6C, 6D, and 6E show side views of each of the six separate interlocking modular parts in their separate orientations. It should be understood that the dimensions and weight of each of these pieces is expected to vary in accordance with the particular regulations or venue specifications controlling the level of the game in which the mound (101) will be utilized. In one embodiment, the dimensions of the six modular part portable pitching mound (101) will be engineered to meet Major League Baseball mound specifications. Accordingly, in one embodiment, it is contemplated that the six piece interlocking modular part pitching mound (101) will be approximately ten inches in height and approximately eighteen feet in diameter.

Generally, as depicted in FIGS. 5A, 5B, 6A, 6B, 6C, 6D, and 6E, the center piece (600) will include a rubber (200) or an insert for a rubber (200) and will generally be the sturdiest and heaviest of the pieces. In one embodiment, the insert for the rubber (200) will be about 6" W×24" L. In addition, in one embodiment, the rubber (200) will be located about 24" from the rear of the front center piece (600) and about 18" from the left side (606) and the right side (607) of the center piece (600). Further, in certain embodiments of the portable pitching mound (101) wherein the portable pitching mound (101) has a generally circular shape, the center piece (600) in the six modular component part embodiment, as demonstrated in FIGS. 5A, 5B, 6A, 6B, 6C, 6D, and 6E, will comprise the center strip of the circular portable pitching mound (101) from the front of the portable pitching mound (101) to an area behind the rubber (200) or the insert to the rubber (200). The back center piece (605) will attach to the back end of the center piece (600) and comprise the end of the center strip from the terminating back end of the center piece (600) to the back peripheral flange (105) edge of the portable pitching mound (101).

Generally, as demonstrated in FIGS. 5A, 5B, 6A, 6B, 6C, 6D, and 6E, these component parts of the circular portable pitching mound (i.e., the center piece (600) and the back center piece (605)), when interlinked together, will have a generally convex orientation with the rubber (200) or insert for the rubber (200) located generally at the apex of the generally convex upper surface (104). As noted previously, and as demonstrated in FIGS. 5A, 5B, 6A, 6B, 6C, 6D, and 6E, the apex of the generally convex upper surface (104) of the center piece (600) may be generally flat, and is not necessarily located at the center of the generally circular portable pitching mound (101). Further, as demonstrated in the aerial view of FIGS. 5A and 5B, the center piece (600) and back center piece (605) will generally comprise the center of the generally circular portable pitching mound (101). As such, the center piece (600) will have a left side (606) and a right side (607) and the back center piece (605) will have a left side (608) and a right side (609). The front left side piece (601), back left side piece (602), front right side piece (603), and back right side piece (604) of the six modular component part pitching mound (101) will generally attach or interlock with the center piece (600) at its left side (606) and right side (607) and the back center piece (605) at its left side (608) and right side (609). In one embodiment, the center piece (600) will be about 156" L×60" W×10" H and the back center piece (605) will be about 60" L (at its center) and 58" (at its sides)×60" W×10" H.

Further, as depicted in FIGS. 5A, 5B, 6A, 6B, 6C, 6D, and 6E, the front left side piece (601) and back left side piece (602) when combined and the front right side piece (603) and back right side piece (604) when combined are generally mirror images of each other and represent the left and right portions of the generally circular portable pitching mound (101), having a generally semi-circle orientation, with each back and front piece of each side corresponding to half of the generally semi-circle orientation. The center flat side (610) (611) (612) (613) of the front left side piece (601), back left side piece (602), front right side piece (603) and back right side piece (604) is the portion of each of the pieces that connects to or interlocks with either the left side of the center piece (606) or the right side of the center piece (607) or the left side of the back center piece (608) or the right side of the back center piece (609). The circular side (620) (621) (622) (623) of the left side piece (601), back lei side piece (602), front right side piece (603) and back right side piece (604) is the portion of each of the pieces that comprises a portion of the peripheral flange (105) of the generally circular portable pitching mound (101). Together with the circular edge of the center piece (600) and back center piece (605), the circular side (620) (621) (622) (623) of each of these pieces creates the exterior circumference of the embodiment of the portable pitching mound (101) comprised of six modular component parts. In one embodiment, the front left side piece (601) will be about 115½"×77¼" W×10" H, the back left side piece (602) will be about 91" L×77" W×10" H, the front right side piece (603) will be about 115½"× 77¼" W×10" H, and the back right side piece (604) will be about 91" L×77" W×10" H.

As will be discussed further herein, in one embodiment of the six modular part portable pitching mount (101), the six component parts will be attached to each other via a flange attachment methodology. In this embodiment, there will be one flange (900) located on the rear side (905) of the front left side piece (601) and on the rear side (906) of the front right side piece (603). In one embodiment, each of the flanges (900) will be about 42" L×2⅜" W. In this embodiment, there will also be three flanges (900) on the center piece (600), one on the left side (606), one on the right side (607) and One on the rear side. In one embodiment, the flanges (900) on the left side (606) and right side (607) will be about 115½" L×2⅜" W and the flange (900) on the rear side will be about 60¾" L×2⅜" W. Further, in this embodiment, there will also be one flange (900) on the center flat side (611) of the back left side piece (602) and the center flat side (613) of the back right side piece (604). Generally, this flange (900) will be about 23" L×2⅜" W. Thus, in sum, in this flange attachment methodology, seven flanges will be utilized to combine the six modular component parts into the resultant portable pitching mound (101).

Figure 7:
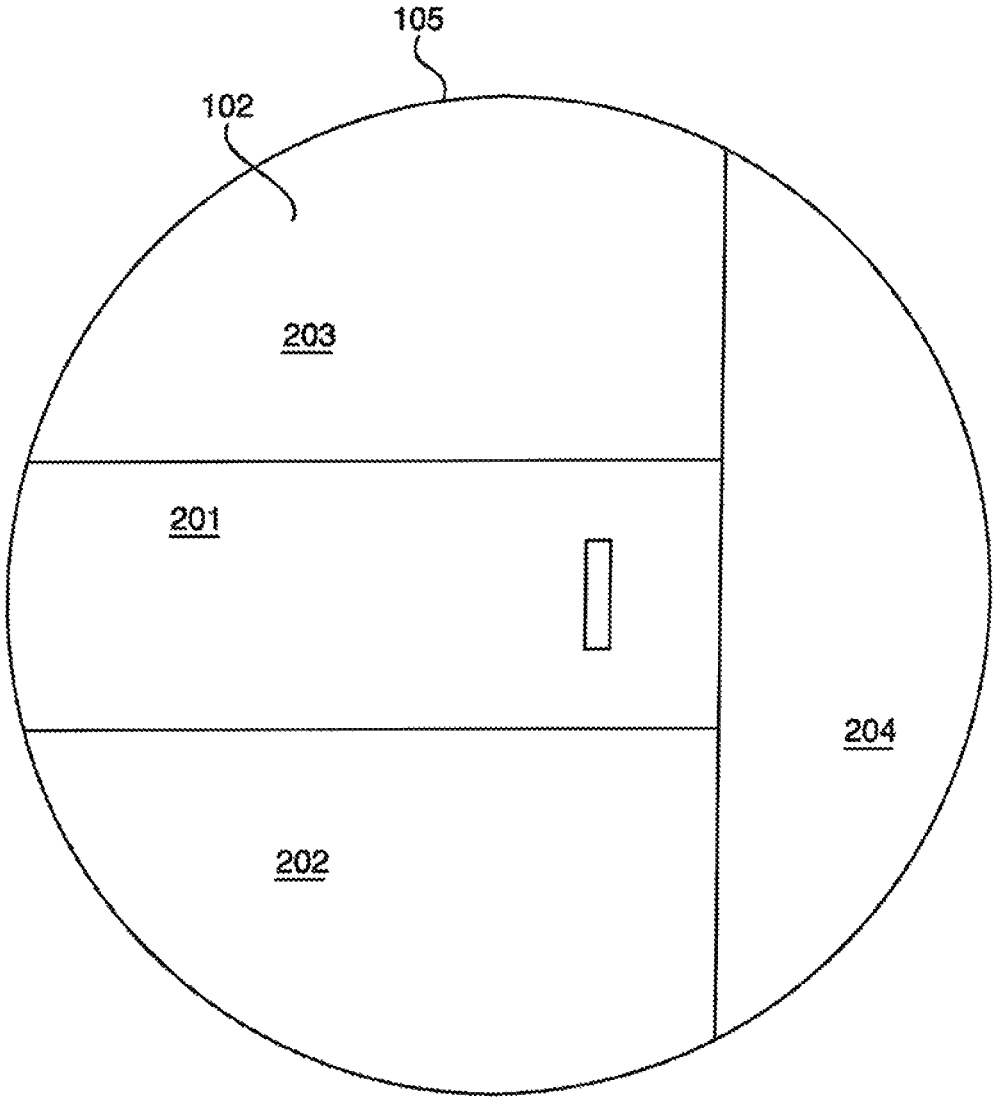
FIG. 7 provides an aerial view of an embodiment of the portable pitching mound comprised of four parts.

In yet another embodiment, depicted in FIG. 7, the mound (101) is comprised of four separate modular parts: a center piece (201), a left piece (203), a right piece (202), and a rear piece (204). FIGS. 8A, 8B, 8C, 8D, 8E, 8F, 8G, 8H, 8I, 8J, 8K, 8L, 8M, 8N, and 8O show aerial and side views of each of the four separate modular parts both in their separate and combined mound orientations. The dimensions and weight of each of these pieces is expected to vary in accordance with the particular regulations controlling the level of the game in which the mound will be utilized. In one embodiment, the center piece (201) will be about 13' L×5' W×10" H, the left piece (203) will be about 6.5' W with edges of 149" L×69" W, the right piece (202) will be about 6.5' W with edges of 149" L×69" W and the rear piece (204) will be about 5' W with edges of 198" L×60" W. Further, regardless of the dimensions of the particular embodiment, it is contemplated that the center piece (201) contains the robber which is not located on the center point of the circular portable pitching mound and will generally be the sturdiest and heaviest of all the other pieces. Further, if needed, it is contemplated that the center piece (201) alone, without the other pieces, can be utilized as a portable pitching mound.

Figure 9:
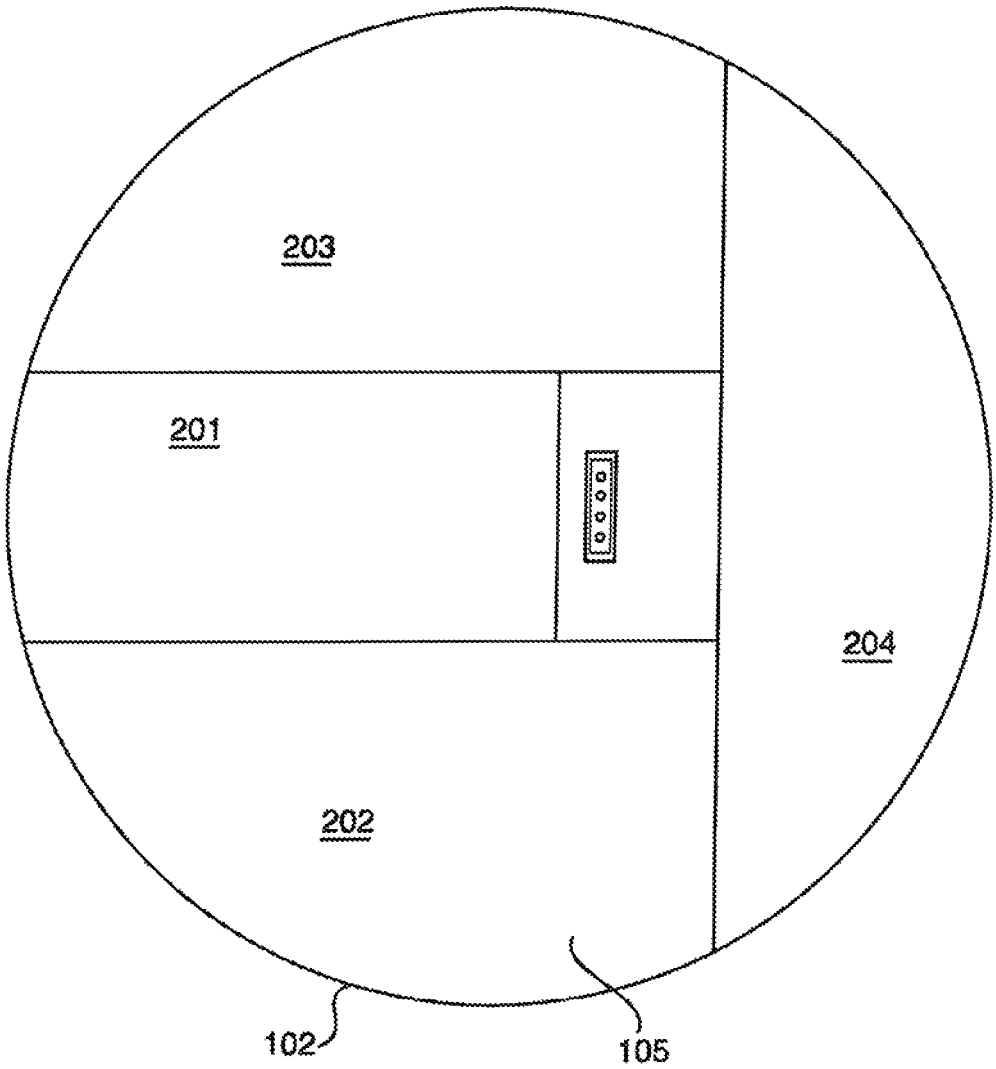
Figure 10:
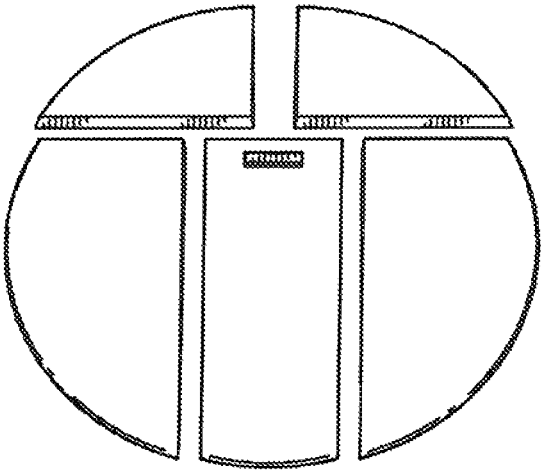
Figure 1:
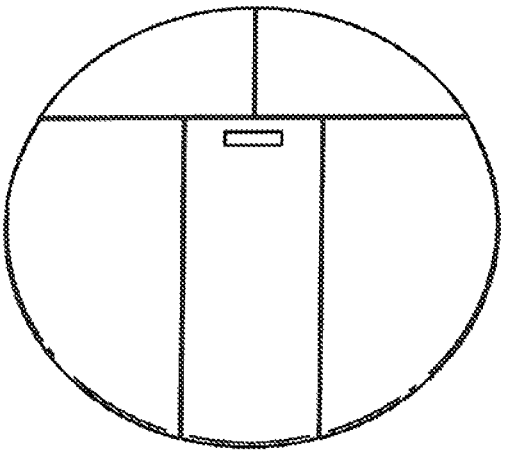

In another embodiment of the pitching mound (101), depicted in FIGS. 9-11, the pitching mound (101) is comprised of five modular parts. In this embodiment, as demonstrated in the FIGS. 9-11, the rear piece (204) of the four-part embodiment is sub-divided into two separate modular parts to create a five-part modular mound.

Notably, depending on the embodiment it should be understood that the pitching mound (101) disclosed herein may be comprised of any number of modular parts. Generally, depending on the embodiment, it should be understood that each of the separate modular component parts can be divided into subparts (as the rear piece is subdivided in FIGS. 5A and 5B. Further, in each of these embodiments it should be understood that the separate component modular parts seamlessly attach and are integrated together via an interlinking methodology disclosed herein to create the portable pitching mound (101) generally without seams or interruptions between the connected component parts.

Figure 12:
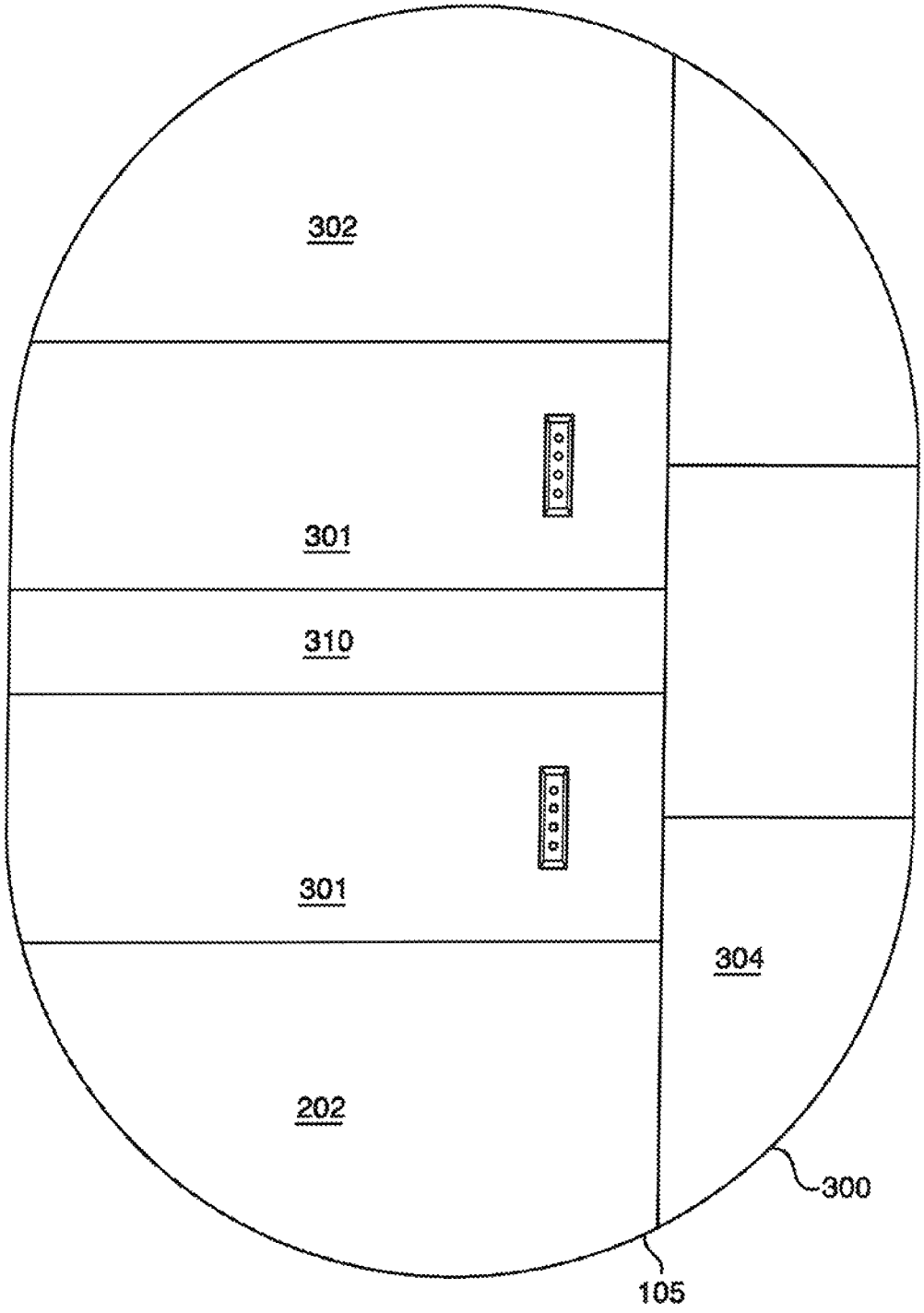
FIGS. 12-14 provide an aerial view of an embodiment of the bullpen mound in its individual parts and final composite formation.
Figure 13:
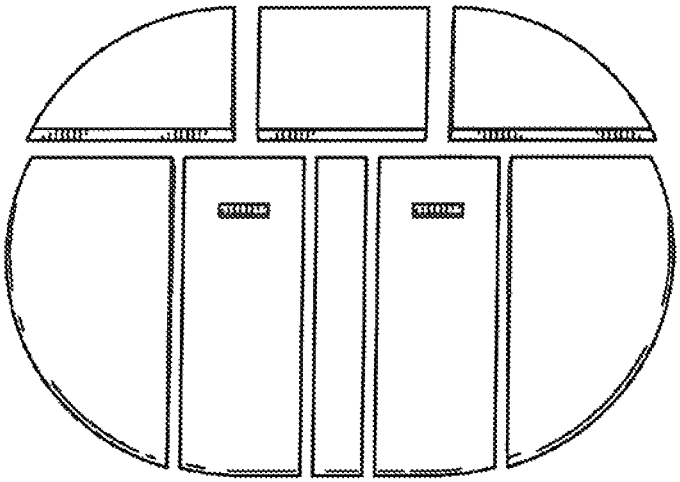
Figure 14:
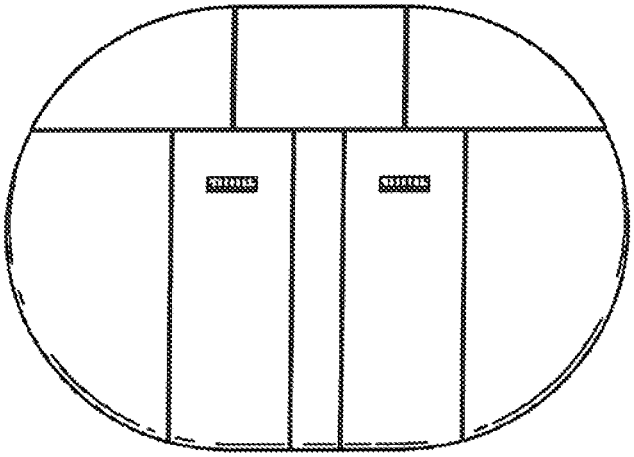

In another embodiment of the pitching mound (101), the modular components of the mound body (102) will be utilized to create a bullpen mound (300). In one embodiment of the bullpen mound (300), depicted in FIGS. 12-14, two or more center pieces (301) will be connected to each other by a connector modular component (310) and a left piece (302), right piece (303) and rear piece (304). The connector modular component (310) can comprise any size modular component that connects the two or more center pieces (301) to each other. Notably, it is contemplated that the left piece (302), right piece (303) and rear piece (304) of this embodiment can be singular pieces or, in alternate embodiments, can be broken into two or more separate connecting pieces. Further, in this embodiment, the overall shape of the resultant, mound (101) is more oval than circular and, in certain embodiments, may be polygonal (such as a square or triangle). While FIG. 12 depicts a bullpen mound (300) comprised of two center pieces (301), it is contemplated that the bullpen mound (300), in alternative embodiments, can be comprised of more than two center pieces (301). For example, in one embodiment where the bullpen mound (300) is utilized in a training environment, the bullpen will be comprised of five center pieces (301).

Figure 15A:
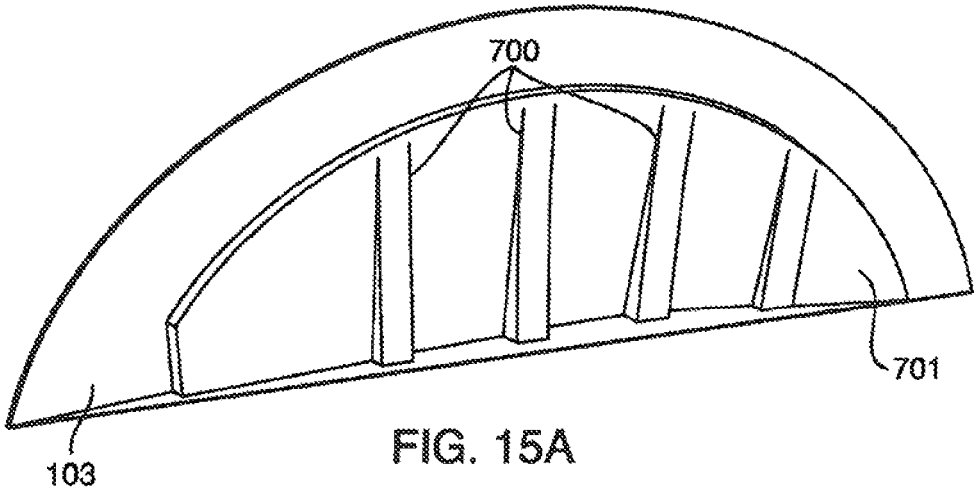
FIGS. 15A and 15B provide a view of an embodiment of the solid foam reinforcement system utilized in some embodiments of the portable pitching mound.
Figure 15B:
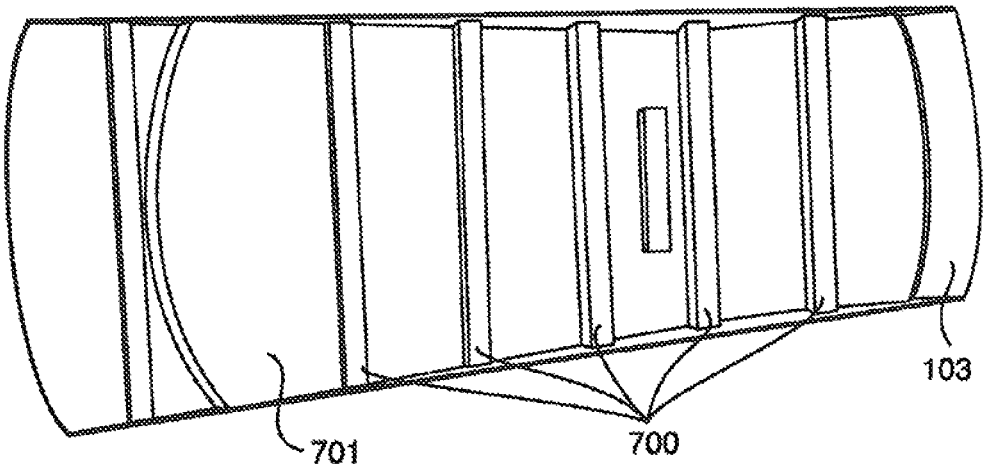

In each embodiment of the pitching mound (101) disclosed herein, each modular part comprising the mound (101) is comprised of fiberglass, carbon fiber or some other lightweight, extremely strong, and robust material known to those of skill in the art. For the purposes of simplicity, all of these lightweight, extremely strong and robust, materials known to those of ordinary skill in the art will be collectively referred to as "fiberglass" herein. In certain, embodiments, the pitching mound (101) will be further comprised of a core material with durability, longevity and proper weight which can attach to the fiberglass (or other utilized material) while maintaining a good binding. Contemplated core materials include, but are not limited to, balsa, plywood, solid foam materials known to those of ordinary skill in the art (such as Styrofoam®) and other artificial core materials known to those of ordinary skill in the art. In one embodiment, fiberglass is the preferred exterior shell material for the mound (101). Further, in one embodiment, the preferred core material is solid foam for its strength, and pliability. It is also contemplated, in certain embodiments, that a reinforcement system will, be added to each modular part of the pitching mound (101). Contemplated reinforcement systems include a polyvinyl chloride (PVC) (or other thermoplastic polymer reinforcement framework), a wooden reinforcement framework, a metal reinforcement framework, solid foam framework known to those of ordinary skill in the art or any other framework known to those of ordinary skill in the art that could support and reinforce each fiberglass modular part of the pitching mound (101). One embodiment of this reinforcement system comprised of foam struts (700) which is then covered by fiberglass to create a lower surface (103) is depicted in FIGS. 15A and 15B.

Generally, in certain embodiments of the pitching mound (101), the fiberglass (or other lightweight, extremely strong, and robust material known to those of skill in the art) in each modular part comprises the upper and lower surface of that modular part and, eventually, the convex upper surface (104) and the lower surface (103) of the pitching mound (101) once the component modular parts of the pitching mound (101) are assembled.

In embodiments of the pitching mound (101) that utilize a core material (which, in one embodiment, is comprised of solid foam), the core material generally lies between the fiberglass (or other lightweight, extremely strong, and robust material known, to those of skill in the art) which comprises the tipper surface (104) and the fiberglass which comprises the lower surface (103) of the modular part and, eventually, the mound (101). Generally, this core material mid-layer is molded and shaped to the curvature of the mound (101). In the embodiments of the mound (101) where a reinforcement system is utilized, this reinforcement system is generally positioned next to the core material. Then final layers of fiberglass are laid onto the lower surface (103) of the modular part thereby coating the core material and reinforcement system (if a reinforcement system is utilized). One embodiment of the core material (701) and a contemplated reinforcement system is provided in FIGS. 15A and 15B.

In certain embodiments of the portable pitching mound (101), it is contemplated that handles, handholds or some other mechanism known to those of ordinary skill in the art will be incorporated into one or all of each the separate modular pieces of the portable pitching mound (101) to facilitate moving and installing the portable pitching mound (101). Contemplated handles and handholds include, but are not limited to, attached pull handles, twist handles, knobs, and carved handhold slots into the modular piece. In one embodiment, it is contemplated that the flanges of the flange attachment methodology will serve a secondary function as handholds.

In other embodiments of the portable pitching mound (101), either prior to or after installation the convex upper surface (103) of the portable pitching mound (101) will be covered with an artificial turf or other known surface utilized to replicate a natural grass, dirt or clay environment. In some embodiments, the convex upper surface (103) of each individual component part will be covered separately. In other embodiments, the entire convex upper surface (103) of the interlinked portable pitching mound (101) will be covered.

As noted previously, in each of the disclosed embodiments of the portable pitching mound (101), it is contemplated that the modular pieces of the embodiment will attach or interlink with each other to create a seamlessly integrated portable pitching mound (101) in accordance with an attachment methodology known to those of ordinary skill in the art. Contemplated attachment methodologies include, but are not limited to, claps, flanges, interlocking componentry pieces, u-shaped channel pipes, hooks, pins, adhesives, hook and loop fastener and other attaching and fastening mechanisms known to those of ordinary skill in the art. One contemplated attachment methodology for the interlocking of the component modular pieces in an embodiment of the portable pitching mound (101) is a flange system. In this system, a series of flanges (i.e., a series of external ridges, rims or lips) are utilized to interlink each of the modular component parts of the portable pitching mound (101). In this system, as demonstrated in FIG. 16, interlinking flanges (900) are placed on one or more sides of each of component modular parts of the portable pitching mound (101). Each of these flanges (900) corresponds with or "locks" into a corresponding flange (900), side or locking mechanism (907) on another component modular part of the portable pitching mound (101) that denotes the portion of the portable pitching mound (101) to which that particular side of that component modular part attaches. In certain embodiments, as depicted in FIGS. 17 and 18, the interlocking flange system will be further comprised of a locking mechanism (902) which will correspond with a locking channel (901) in a flange (900). Generally, as depicted in FIGS. 17 and 18, the "locking mechanism" (907) will comprise a "V," "U," "T," or other mechanical protruding projection that fits within a corresponding locking channel (901) or depression in a flange (900). When the locking mechanism (907) is inserted into the corresponding locking channel (901), tangential movement of the separate pieces is generally eliminated.

Generally, it is contemplated that, each modular part of the pitching mound (101) will be molded separately. In one embodiment, it is contemplated that the modular pieces of the pitching mound (101) will be molded as follows. In a first step, two or more layers of fiberglass are laid inside a mold. Then, in a second step, a core material, such as solid foam, is laid into the mold and shaped into the curvature of the mold and the previously laid layers of fiberglass. In one embodiment, about 1" of solid foam will be laid into the mold and shaped into the curvature of the mold. Next, in a third step, a reinforcement system is laid against the solid foam. In one embodiment, solid foam struts, such as about 2" H×3" W, is laid against the solid foam core material to create one or more struts. Then, in a fourth step, a final two or more layers of fiberglass are laid onto the underside of the modular piece, coating the core material and reinforcement system, as demonstrate in FIGS. 15A and 15B. After the fiberglass is allowed to dry, the modular piece will be removed from the mold. Once removed, in one embodiment, the modular piece will be sanded to roughen the surface, creating a better surface for adhesive binding. Also, in one embodiment, hand holes will be cut into the side or sides of the modular piece to assist in the movement of the modular piece. Notably, in certain embodiments of this process of manufacturing the modular pieces, when the center piece is the piece being manufactured it is contemplated that this piece will be constructed with more bracing due to the fact that this portion of the mound (101) generally receives the most wear and impact, due to pitchers pushing off and landing as they throw on this area of the mound (101).

Generally, the completed pitching mound (101) will be installed as follows. First, the portion of the baseball field or practice area where the pitcher's rubber should be placed is located. The center piece will be placed so the front of the rubber (200) is the necessary distance from the front of home plate and in a straight line with second base in accordance with the proper regulations. For example, in one embodiment, the center piece will be placed about 60 feet, 6 inches from the front of home plate. Generally, the center piece will be the sturdiest and heaviest of each of the modular pieces. In fact, due to its shape and resilience, the center piece, in certain embodiments, can be used individually as a bullpen mound.

In the next step, the remaining modular pieces are inserted in the respective flanges along the center piece, thereby locking the modular pieces together (in the embodiment of the portable pitching mound (101) in which a flange attachment methodology is utilized). In embodiments of the portable pitching mound (101) where the mound (101) is comprised of more than three modular parts, this connection/insertion process continues until each of the separate modular component parts are attached into each other, creating the generally circular portable pitching mound (101). Thus, generally each modular piece of the portable pitching mound (101) will be positioned on a field as desired and connected through an interlocking flange attachment system or other utilized attachment, methodology known to those of ordinary skill in the art. Generally, as noted previously, irrespective of the attachment methodology utilized, in each embodiment it is contemplated that the component modular parts will seamlessly integrate with each other once assembled into the unitary portable pitching mound (101).

In a next step, following the connection of the pieces of the mound (101), the mound (101) is covered with artificial turf or a similar field surface condition substitute, in the embodiment in which the mound (101) is permanent, the mound (101) will be completely covered by turf. For example, in one embodiment two pieces of carpet will be utilized and a center piece of turf that is replaceable will be created. In one embodiment, this center piece of turf will be 3' wide by 8' long and secured with 2" or hook and loop fastener or other fastener known to those of ordinary skill in the art. In the embodiment in which the mound (101) is portable, each modular piece of the mound (101) will be covered individually and either glued into place or affixed, via a 2" hook and loop fastener which is attached to the edges of the piece. This fastener will be utilized to secure the turf to the convex upper surface (104) of the assembled mound (101) or modular component parts of the mound (101). The edges of the mound (101) will then be trimmed to ensure that there is no lip between the turf on the mound and the turf on the field. Notably, it is contemplated that none of the embodiments disclosed herein will have a lip edge between the portable pitching mound (101) and the field once the portable pitching mound (101) is installed. In a final installation step, the rubber (200) is installed in the slot which is formed in the mound (101). FIG. 2 depicts an aerial view of a folly installed mound (101) on a baseball diamond.

In sum, the pitching mound (101) disclosed herein offers a permanent or portable all-turf solution that meets the needs of every level of baseball. Due to its fiberglass and core material-based construction, the pitching mound (101) is comprised of a long-lasting construction which is engineered for playability and durability. Further, the pitching mound (101) offers the strength and durability of a traditional dirt mound, while offering an additional feature of being soft enough not to injure a pitcher. The pitching mound (101) allows a pitcher to throw pitches from the mound (101) with ease, giving him the natural feeling of standing on a dirt mound. The portability of the pitching mound (101) is another advantage. This portability allows for the convenience of transforming the baseball field into another playing field without increased cost or required labor. Another benefit is the flexibility of the pitching mound (101); it can be adapted to dirt, grass or turf surfaces and is built to work with any type of artificial turf. Still further, the pitching mound (101) is designed to unique specifications to remove the dangerous lip which was present in the portable baseball mounds of the prior art. Finally, the portable pitching mound (101) is easy to utilize and maintain. Because it is engineered to maintain a constant shape, the hours of maintenance associated with traditional dirt mounds are not required.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A circular portable pitching mound comprised of:

a front center piece including a flat vertical left side, a flat vertical rear side, and a flat vertical right side, each of which include an interlocking flange protruding horizontally from a base thereof, the front center piece further comprising a rubber located on a convex upper surface;

a rear center piece including a flat vertical left side, a flat vertical front side, and a flat vertical right side, each of which include an interlocking flange protruding horizontally from a base thereof;

a front right piece including a flat vertical left side and a flat vertical rear side, each of which include an interlocking flange protruding horizontally from a base thereof;

a front left piece including a flat vertical right side and a flat vertical rear side each of which include an interlocking flange protruding horizontally from a base thereof;

a rear right piece including a flat vertical left side and a flat vertical front side each of which include an interlocking flange protruding horizontally from a base thereof;

a rear left piece including a flat vertical right side and a flat vertical front side each of which include an interlocking flange protruding horizontally from a base thereof;

wherein, said interlocking flanges are interlocked together at said bases of each of the front left, rear left, front right, rear right, front center, and rear center pieces to place said vertical sides of the various of said front left, rear left, front right, rear right, front center, and rear center pieces adjacent to each other and to form a circular mound body with a flat base and a convex upper surface;

wherein said interlocking flanges comprise the sole form of attachment between said front left, rear left, front right, rear right, front center, and rear center pieces; and wherein said interlocking flanges interlock via a channel and a protrusion.

2. The portable pitching mound of claim 1 wherein said protrusion is a sloping protrusion.

* * * * *